US006751972B1

(12) United States Patent
Jungwirth

(10) Patent No.: US 6,751,972 B1
(45) Date of Patent: Jun. 22, 2004

(54) APPARATUS FOR SIMULTANEOUS HEATING COOLING AND HUMIDITY REMOVAL

(75) Inventor: Curtis A. Jungwirth, 23275 NE. Dayton Ave., Newberg, OR (US) 97132

(73) Assignee: Curtis A. Jungwirth, Newberg, OR (US)

( * ) Notice: Subject to any disclaimer, the term of this patent is extended or adjusted under 35 U.S.C. 154(b) by 0 days.

(21) Appl. No.: 10/299,441

(22) Filed: Nov. 18, 2002

(51) Int. Cl.[7] ..... F25B 27/00; F25D 17/02
(52) U.S. Cl. ..... 62/238.6; 62/430; 62/434
(58) Field of Search ..... 62/238.6, 434, 62/430, 238.1, 238.7, 160

(56) References Cited

U.S. PATENT DOCUMENTS

| | | | | |
|---|---|---|---|---|
| 1,874,803 A | | 8/1932 | Reed | |
| 1,969,187 A | | 8/1934 | Shutt | |
| 3,916,638 A | | 11/1975 | Schmidt | |
| 4,044,568 A | | 8/1977 | Hagen | |
| 4,134,274 A | | 1/1979 | Johnsen | |
| 4,159,595 A | | 7/1979 | Dalle et al. | |
| 4,192,146 A | | 3/1980 | Credé | |
| 4,205,532 A | | 6/1980 | Brenan | |
| 4,291,757 A | | 9/1981 | Redden | |
| 4,444,020 A | | 4/1984 | Varga | |
| 4,507,929 A | | 4/1985 | Dozier | |
| 4,856,578 A | * | 8/1989 | McCahill | 165/241 |
| 4,878,357 A | * | 11/1989 | Sekigami et al. | 62/160 |
| 5,241,829 A | | 9/1993 | Irie et al. | |
| 5,901,563 A | * | 5/1999 | Yarbrough et al. | 62/238.7 |
| 5,906,104 A | * | 5/1999 | Schwartz et al. | 62/79 |
| 5,944,089 A | | 8/1999 | Roland | |
| 2002/0194857 A1 | * | 12/2002 | Kato et al. | 62/185 |

* cited by examiner

*Primary Examiner*—Chen Wen Jiang
(74) *Attorney, Agent, or Firm*—Klarquist Sparkman, LLP

(57) ABSTRACT

An apparatus for simultaneous heating and cooling includes a heating system and a cooling system, each having a plurality of heat exchangers coupled by a refrigerant circulation system, the refrigerant transfer system having refrigerant flow selection means for controlling the flow of heat-carrying refrigerant, whereby a refrigerant flow selection means selectively routs refrigerant flow between heating and cooling system heat exchangers selected by the flow selection means. The apparatus includes embodiments wherein the heating system heat exchangers comprise a condenser and a vessel containing water, the cooling system heat exchangers comprise an evaporator and a vessel containing water, and refrigerant flow paths are selected by a plurality of valves that select heat exchangers. The apparatus further includes an air handling system for moving air so as to be in thermal contact with selected heat exchangers, whereby air having moisture is dried.

25 Claims, 3 Drawing Sheets

APPARATUS FOR SIMULTANEOUS HEATING COOLING AND HUMIDITY REMOVAL

FIELD OF THE INVENTION

This invention relates to systems for heating and cooling, and more particularly to systems that simultaneously heat and cool, with the capability of dehumidifying ambient air.

BACKGROUND

The desirability of using heat extracted during a cooling process is well appreciated. For example, heating a vessel containing water using heat extracted from the air is desirable in the wine industry to heat or cool grape juice and control the fermentation process.

An apparatus and process of simultaneous heating and cooling could also be used in aquatic industries. For example such an apparatus could be used to simultaneously cultivate fish requiring a hot environment and to cultivate fish requiring a cold environment. Normally fish are raised indoors, creating very high humidity, therefore it is desirable to extract latent heat and moisture from the air, transfer the extracted heat and moisture to a pond. Such an apparatus will reduce maintenance costs, reduce water loss, and save energy.

SUMMARY

As a means for providing simultaneous heating and cooling, with attendant dehumidification, an apparatus is disclosed for simultaneously heating and cooling a material. The apparatus comprises a heating system and a cooling system, each with a plurality of heat exchangers in fluid communications with a refrigerant circulation means having refrigerant transfer selection means. The refrigerant transfer selection means comprises refrigerant transfer paths for routing refrigerant flow. The refrigerant transfer selection means has a path selection device for controlling and selecting transfer paths for the flow of heat-carrying refrigerant between heat exchangers. The refrigerant transfer selection means selects heat exchangers by routing refrigerant flow. By further including an air handling system to move air to be in thermal contact with heat exchangers air is dehumidified, when heat exchangers are selected from the group consisting of an air condenser and an air evaporator.

The refrigerant circulation means comprise a compressor, refrigerant, a receiver, and mechanisms for storing and conveying refrigerant. The refrigerant circulation means is operable to function according to principles well understood in the art of heating and cooling systems.

One aspect of the invention is exemplified by an apparatus comprising a heating system for taking up heat from a circulating refrigerant for the purpose of releasing heat to a material. The heating system has a plurality of heat exchangers, and a refrigerant transfer selection means. The refrigerant transfer selection means comprises refrigerant transfer paths and a path selection device. A heat exchanger in the heating system is selected by the refrigerant transfer selection means, the selected heat exchanger taking up heat from circulating refrigerant.

A second aspect of the invention is exemplified by an apparatus comprising a cooling system for releasing heat to a circulating refrigerant. The cooling system has a plurality of heat exchangers and a refrigerant transfer selection means. The refrigerant transfer selection means comprises transfer paths and a path selection device. One of the heat exchangers in the cooling system is selected by the refrigerant transfer selection means, the selected heat exchanger releasing heat to circulating refrigerant for the purpose of cooling collocated or ambient materials.

The first and second aspects are demonstrated by a first embodiment having a heating system wherein the heat exchanger is selected from either a condenser or a vessel containing water, and a cooling system wherein the heat exchanger selected from either an evaporator or a vessel containing water.

Another aspect of the invention is illustrated by a heating and cooling apparatus comprising the first and second aspects, wherein the apparatus further includes an air handling system operable for moving air, and used in conjunction with the heating system and cooling system as a means to de-humidify air. This aspect is illustrated by a second embodiment with heating and cooling systems have selectable heat exchangers, and further including a fan to effect air exchange between the selectable heat exchangers, thereby to remove humidity from air exchanged.

DETAILED DESCRIPTION

A First Aspect

Figure 1:
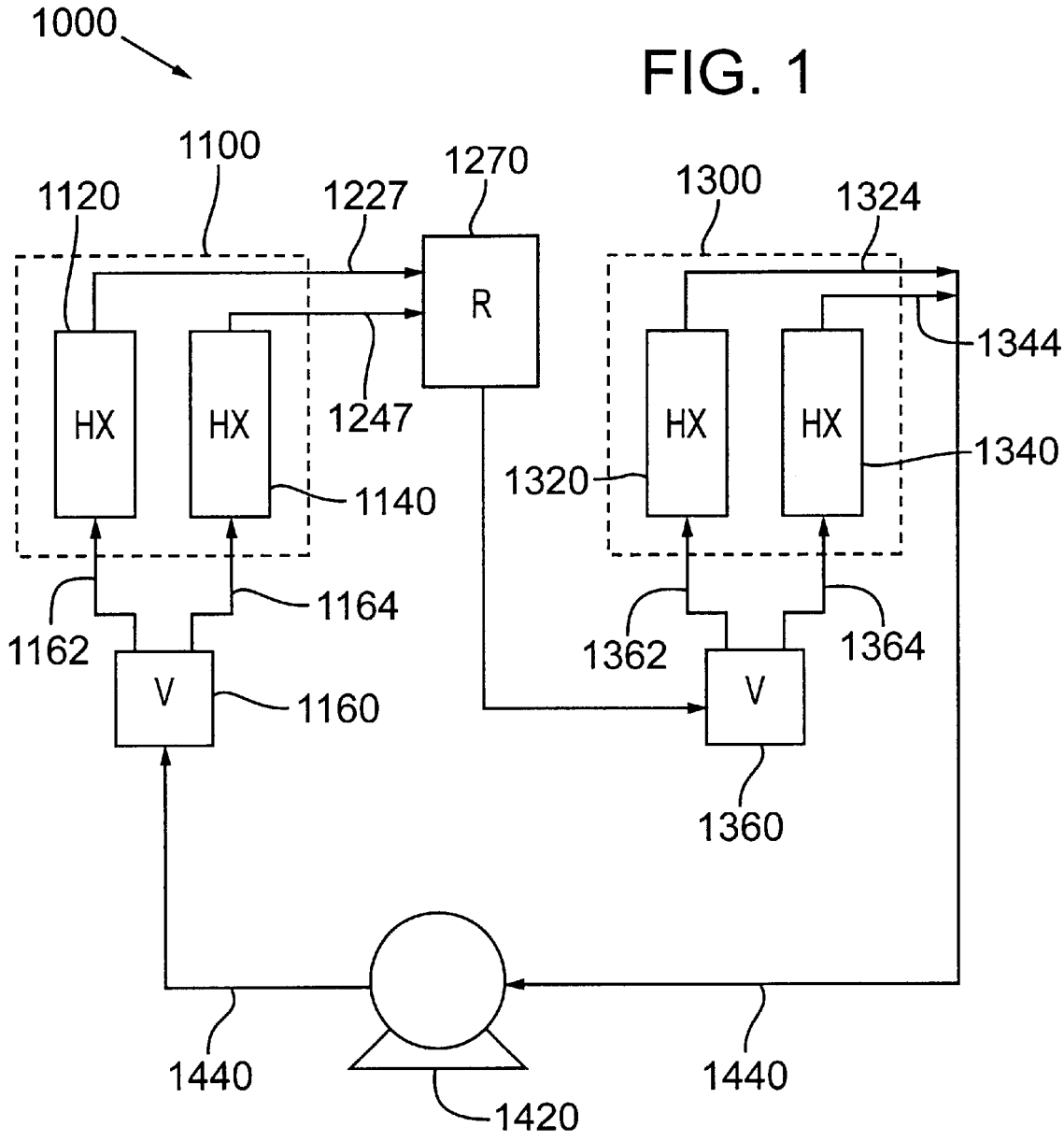
FIG. 1 is a diagram illustrating the first aspect and second aspect of the invention, the first and second aspects represented in a first embodiment by an apparatus having a heating device and a cooling device exchanging heat with a circulating refrigerant, the heating device and the cooling device each having a plurality of selectable heat exchangers, with heat exchangers selected by the refrigerant transfer selection means.

With reference to FIG. 1, the first aspect comprises an apparatus 1000 having a heating system 1100, and a cooling system 1300, the heating and cooling systems in fluid communications by refrigerant circulating through a receiver 1270. Heat is exchanged through fluid communications between the heating system 1100 and the cooling system 1300 by a refrigerant circulation means. The refrigerant circulation means comprises a compressor 1420, a receiver 1270 and a refrigerant circulation system 1440. The refrigerant circulation system is in fluid communications with a plurality of refrigerant transfer paths 1162, 1164, 1227, and 1247, the transfer paths for routing refrigerant flow in the heating system.

The heating system 1100 has a plurality of heat exchangers represented by a first heat exchanger 1120 and a second heat exchanger 1140. One of the heat exchangers, 1120 or 1140, is selected by a first path selection device 1160, whereby circulating refrigerant is transferred to the selected heat exchanger by a selected refrigerant transfer path. By selecting the heat exchanger, either 1120 or 1140 is made operable to take up heat from the circulating refrigerant.

The cooling system has a plurality of heat exchangers represented by a first heat exchanger 1320 and a second heat exchanger 1340. A heat exchanger, 1320 or 1340, is selected by a second path selection device 1360, whereby circulating refrigerant is transferred to the selected heat exchanger by a selected cooling system refrigerant transfer path. The heat exchanger, either 1320 or 1340, selected by the cooling system refrigerant transfer selection means is made operable to release heat to the circulating refrigerant. The cooling system path selection device 1360 controls the flow of refrigerant by selecting flow through the refrigerant transfer paths 1362, 1364, 1324 and 1344.

With reference to FIG. 1, the heating system 1100 has a first heat exchanger 1120 and a second heat exchanger 1140, the first heat exchanger being in fluid communication by a refrigerant transfer path 1227 with a receiver 1270. The second heat exchanger 1140 is also in fluid communications by a refrigerant transfer path 1247 with the receiver 1270. One of the heat exchangers 1120, 1140 is selected by the heating system refrigerant transfer selection means to be in heat transfer communications with circulating refrigerant. The selected heat exchanger, either 1120 or 1140, takes up heat from refrigerant which flows to the receiver 1270. When the first heat exchanger 1120 is selected by the heating system refrigerant transfer selection means path selection device 1160, circulating refrigerant flows through the heating system path selection device 1160, through the refrigerant transfer path 1162 to be in heat transfer communications with the heat exchanger 1120. Refrigerant then flows through the refrigerant transfer path 1227 to the receiver 1270.

With reference to FIG. 1, when the second heat exchanger 1140 of the heating system 1100 is selected by the heating system path selection device 1160 the second heat exchanger 1140 is in heat transfer communications with flowing refrigerant. When the second heat exchanger 1140 is selected, refrigerant flows through the heating system path selection device 1160, through the refrigerant transfer path 1164 to effect a heat energy exchange between the refrigerant and the heat exchanger 1140. Then refrigerant flows through the refrigerant transfer path 1247 to the receiver 1270.

With respect to FIG. 1, the receiver 1270 accumulates refrigerant and causes a pressure drop in the refrigerant before refrigerant flows to the cooling system 1300.

A Second Aspect

In a second aspect of the invention, and also with reference to FIG. 1, the cooling system 1300 has a plurality of heat exchangers, with a heat exchanger selected by a cooling system refrigerant transfer selection means.

With reference to FIG. 1, the cooling system 1300 has a first heat exchanger 1320 and a second heat exchanger 1340, the first heat exchanger being in fluid communication by the refrigerant transfer path 1324 with the refrigerant circulation mechanism 1440. The second heat exchanger 1340 is in fluid communications by the refrigerant transfer path 1344 with the refrigerant circulation mechanism 1440. One of the heat exchangers, 1320 or 1340, is selected to be in heat transfer communications with the refrigerant. The selected heat exchanger, 1320 or 1340, releases heat to the refrigerant which flows by the refrigerant circulation means 1440 to the compressor 1420. A heat exchanger, either 1320 or 1340 is selected to be in heat transfer communications with refrigerant flow, the heat exchanger being selected by a cooling system refrigerant transfer selection means.

If the first heat exchanger 1320 is selected by the cooling system path selection device 1360, circulating refrigerant flows from the receiver 1270 through the heating system path selection device 1360, through the refrigerant transfer path 1362 to be in heat transfer communications with the heat exchanger 1320, thence refrigerant flows through the refrigerant transfer path 1324 by the refrigerant circulation means 1440 to the compressor 1420.

With reference to FIG. 1, when the second heat exchanger 1340 of the cooling system 1300 is selected by the cooling system path selection device 1360, the second heat exchanger 1340 is in heat transfer communications with flowing refrigerant. When the second heat exchanger 1340 is selected by the the cooling system path selection device 1360, refrigerant flows from the receiver 1270 through the cooling system path selection device 1360, through the refrigerant transfer path 1364 to effect a heat energy exchange between the refrigerant and the heat exchanger 1340. Refrigerant then flows through the refrigerant transfer path 1344, and by the refrigerant circulation means 1440, to the compressor 1420.

The compressor 1420 concentrates heat energy in the refrigerant, which flows by the refrigerant circulation means 1440 to the heating system path selection device 1160.

The path selection devices 1160 and 1360 may be manually operated to select heat exchangers or the refrigerant transfer selection means may be operated by an automated control system. The path selection devices may be operated to select heat exchangers periodically, or according to some pre-specified set of time intervals, or according to ambient conditions, or they may be selected on a random basis.

A Third Aspect

Figure 2:
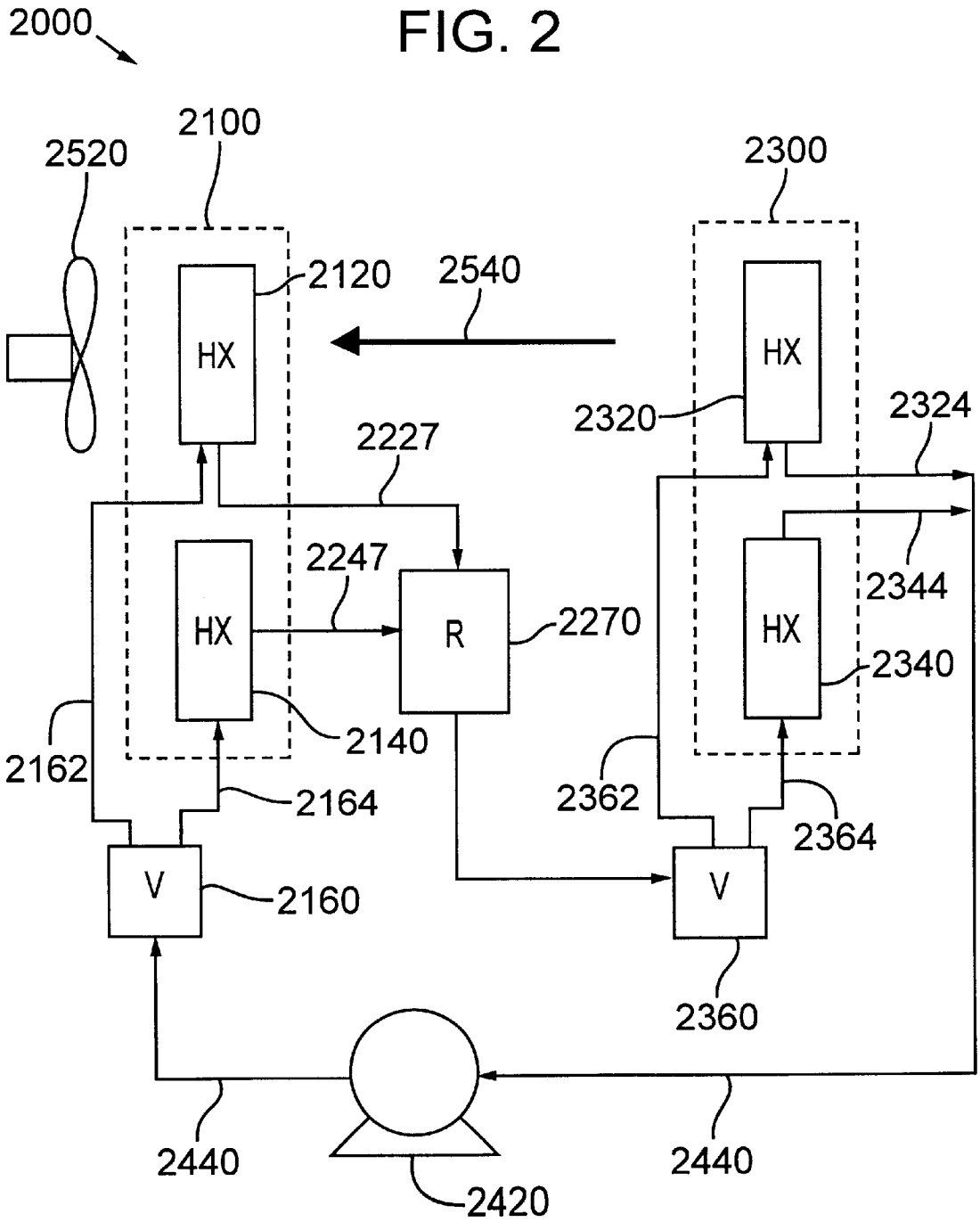
FIG. 2 is a diagram of an apparatus that illustrates the third aspect of the invention, an apparatus that de-humidifies air by selectable heat exchangers and an air handling system.

A third aspect of the invention 2000 is illustrated by the apparatus of FIG. 2. In FIG. 2, the apparatus comprises a heating system 2100 and a cooling system 2300 in fluid communications by a refrigerant circulating through a receiver 2270, and also in fluid communications by a refrigerant circulating through a compressor 2420.

The heating system 2100 of the apparatus 2000 has a plurality of heat exchangers represented by a first heat exchanger 2120 and a second heat exchanger 2140. Heating system path selection device 2160 selects a heat exchanger to be in fluid communications with circulating refrigerant that flows from the compressor 2420 through the heating system path selection device 2160. Refrigerant then flows through either refrigerant transfer path 2162 or refrigerant transfer path 2164, the transfer path selected by the heating system path selection device 2160. Refrigerant flows so as to be in heat transfer communications with the heating system first heat exchanger 2120 or the heating system second heat exchanger 2140. The heat exchanger, 2120 or 2140, in heat transfer communications with refrigerant circulating by a transfer path, either 2162 or 2164, is selected by the heating system valve path selection device 2160.

The cooling system 2300 of the apparatus 2000 has a plurality of heat exchangers exemplified by the first heat exchanger 2320 and the second heat exchanger 2340. Cooling system refrigerant transfer selection means 2360 selects a heat exchanger to be in fluid communications with circulating refrigerant that flows from the receiver 2270 through the cooling system path selection device 2360. Refrigerant flows through either refrigerant transfer path 2362 or refrigerant transfer path 2364, the transfer path being selected by the cooling system path selection device 2360. Refrigerant then flows to be in heat transfer communications with the cooling system first heat exchanger 2320 or the cooling system second heat exchanger 2340, the heat exchanger selected being in heat transfer communications with refrigerant circulating by the transfer path being selected by the cooling system valve selection mechanism 2360.

The apparatus 2000 further has an air-handling system operable for moving air, the air handling system comprising an air mover 2520 and an air transfer means 2540. The air-mover 2520 and air-transfer means 2540 move air to be in heat transfer communications with the heating system first heat exchanger 2120 and the cooling system first heat exchanger 2320.

Using the apparatus 2000, air is dehumidified by a method comprising: (1) by the heating system refrigerant transfer selection means, selecting the heating system first heat exchanger 2120; (2) by the cooling system refrigerant transfer selection means, selecting the cooling system first heat exchanger 2320; (3) operating the refrigerant circulation means; and (4) activating the air-handling system, whereby air containing moisture is moved by the air mover 2520 to be in heat transfer communications with the cooling system first heat exchanger 2320 and is further moved to be in heat transfer communications with the heating system first heat exchanger 2120, whereby moisture is removed from the moving air.

An Exemplary Embodiment Combining the First, Second and Third Aspects

Figure 3:
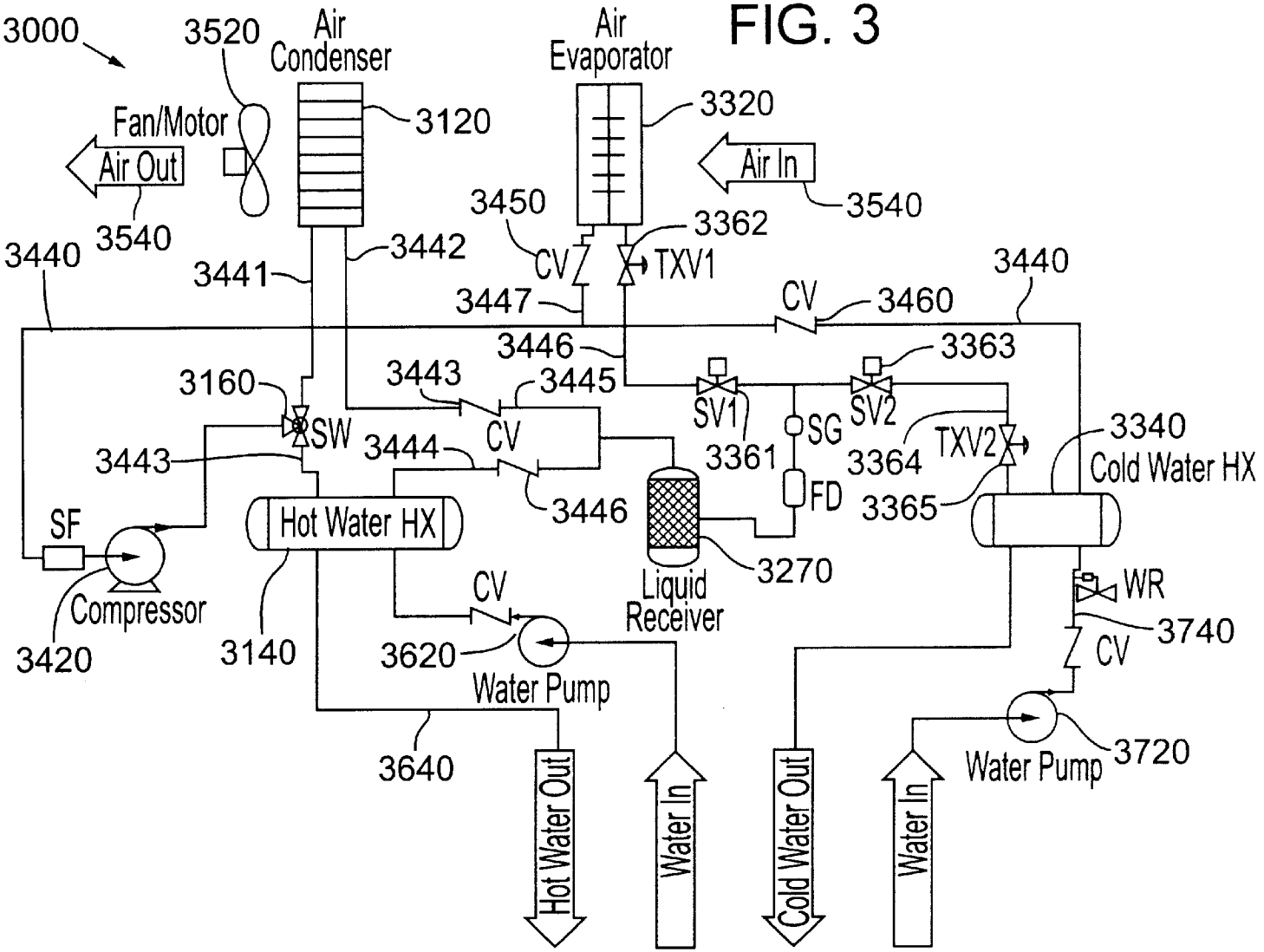
FIG. 3 is a detailed diagram showing an embodiment incorporating three aspects of the invention, wherein the embodiment comprises a system that heats, cools and removes moisture from the air by selectable heat exchangers, the embodiment suitable for deployment in an environment such as an indoor fish hatchery for cultivating cold-water and warm-water fish.

With reference to FIG. 3, an exemplary embodiment of the apparatus 3000 is shown, the apparatus combining the three disclosed aspects of the invention for use in an indoors farm for raising fish or other comparable environment, the apparatus comprising the dehumidification system, a heating system and a cooling system. The heating system has a first heat exchanger 3120 that is an air condenser and a second heat exchanger 3140 that is a vessel containing water. Either the condenser 3120 or the water vessel 3140 is selected by a switching valve 3160 to transfer heat to a circulating refrigerant transferred through piping 3440 by a compressor 3420. When the switching valve 3160 selects the air condenser 3120, refrigerant flows from the compressor 3420 through piping 3440 through the switching valve 3160 and through the transfer path 3441 to be in heat transfer communications with the condenser 3120. After releasing heat to the air condenser 3120, refrigerant flows through refrigerant transfer path 3442 through a check valve 3443 to the liquid receiver 3270. If the switching valve 3160 selects the water vessel, refrigerant flows from the compressor 3420 through the switching valve 3160, through the refrigerant transfer path 3443 to be in heat transfer communications with the water vessel 3140, and to release heat thereto. The refrigerant then flows though the refrigerant transfer path 3444 through a check valve 3446 and to the receiver 3270.

With reference to FIG. 3, the apparatus has a cooling system comprising two heat exchangers, an air evaporator 3320 and a water vessel 3340, wherein one of the heat exchangers is selected by the operations of a first solenoid valve 3361 and a second solenoid valve 3363. If the air evaporator is selected, the first solenoid valve 3361 is operated to permit refrigerant flow from the receiver 3270, through the first solenoid valve 3361, through the refrigerant transfer path 3446, and through a first thermal expansion valve 3362, the refrigerant being in heat transfer communications with the air evaporator 3320, whereby heat is transferred from the evaporator 3320 to the refrigerant. Refrigerant then flows through a first check valve 3450, and then by the refrigerant piping 3440 to the compressor 3420.

When the first solenoid valve 3361 is operated to permit refrigerant flow to the evaporator 3320, the second solenoid valve 3363 operates to prevent flow to the water vessel 3340.

If the water vessel 3340 is selected as a heat exchanger, the first solenoid valve 3361 is operated to prevent refrigerant flow to the evaporator 3320. The second solenoid valve 3362 operates to permit refrigerant flow from the receiver 3270, through the second solenoid valve 3363, through the refrigerant transfer path 3364, through a second thermal expansion valve 3365 to be in heat transfer communications with the water vessel 3340. The water vessel 3340 releases heat energy to the circulating refrigerant, which flows through piping 3440 and a second check valve 3460, then to the compressor 3420.

When the cooling system is operated to select the water vessel 3340 the first solenoid valve 3361 operates to prevent refrigerant flow to the air evaporator 3320 and the second solenoid valve 3362 is operated to select the water vessel 3340.

When the air condenser 3120 is selected and the air evaporator 3320 is selected the air dehumidifying system may also be operated to move air to be in thermal contact with the condenser 3120 and the evaporator 3320. When so operated, an air fan motor 3520 is engaged to move air through some conveyance means 3540. The conveyance means may either be a conduit, piping, an unenclosed space or a path in the space between the air condenser 3120 and the air evaporator 3320. When air is moved to be in thermal contact with the heat exchangers, moisture in the air is removed.

When the switching valve 3160 is operated to select the first water vessel 3140 and the first solenoid valve 3361 and the second solenoid valve 3363 are operated to select the second water vessel 3340, water may be circulated to be in thermal contact with the two heat exchangers and thereby to both heat and cool water at the same time. A first water circulation means comprising a first water pump 3620 and a first water conveyance means 3640 are engaged to circulate water to be in thermal contact with the first water vessel 3140 and thereby to heat water circulated by the first water conveyance means 3640. A second water circulation means comprising a second water pump 3720 and a second water conveyance means 3740 are operated to circulate water to be in thermal contact with the second water vessel 3340. Circulating water releases heat to the second water vessel 3340 and is thereby cooled.

When the exemplary embodiment is located in a fish hatchery growing both warm water and cold water fish, significant benefit will be realized from its application. It will be appreciated that the second water circulation means comprising a second water pump 3720 and a second water conveyance means 3740 can be operated to circulate water from a pond containing fish requiring a cold environment. By the action of the exemplary embodiment, water is taken from the cold-water fish pond, is cooled by the heat exchanger 3340 and returned to the cold-water fish pond. Heat taken from water coming from the cold-water fish pond is then transferred to the heating system. At the same time, the first water circulation means comprising the first water pump 3620 and the first water conveyance means 3640 are engaged to circulate water to be in thermal contact with the first water vessel 3140 selected as the heat exchanger. By the combined action of the heating system, the first water circulation means and the first water conveyance means, water taken from the warm-water fish pond is heated and returned to the pond.

In addition, by equipping the apparatus with a third water circulation means, moisture extracted from air during dehumidification can be transferred to either of the fish ponds.

DISCLOSURE SUMMARY

An apparatus has been disclosed for simultaneous heating and cooling, wherein heat exchangers are selected to be in thermal communications with a circulating refrigerant. A first embodiment demonstrating the apparatus is disclosed wherein the heating system has a first and a second heat exchanger selected by the refrigerant transfer selection means, and the cooling system has a first and a second exchanger also selected by the refrigerant transfer selection means. Variations to the first embodiment comprise (1) providing more or different kinds of heat exchangers for either or both the heating and cooling systems; (2) providing a plurality of heat exchangers, wherein the number of heat exchangers for the cooling system is not equal to the number of heat exchangers for the heating system; (3) using embodiments of the refrigerant transfer selection means that are different from those disclosed; (4) adding automatic or a combination of automatic and manual controls to control the selection of heat exchangers; and, (5) providing a refrigerant circulation system that is different from that disclosed, but wherein the heat exchangers are selected to receive heat energy from and return heat energy to circulating refrigerant; and, (6) different ways of arranging or packaging components of the apparatus.

The apparatus disclosed includes an air moving system operable to cause air to circulate air between selected heat exchangers for the purpose of removing moisture from the air. Modifications to the dehumidification apparatus include (1) variations in the air handling mechanism; (3) use of the apparatus to remove moisture from gases other than normal air.

Although the invention has been illustrated with reference to specific embodiments, it is not intended that the invention be limited to those illustrated. Those skilled in the art will recognize that the previously described modifications can be made without departing from the spirit and scope of the invention. Therefore, it is intended that this invention comprises all the variations and modifications encompassed by the following claims.

I claim:

1. An apparatus for simultaneously heating and cooling fluids, the apparatus comprising:

a refrigerant circulation means for circulating a refrigerant for heat transfer;

a heating system having a first plurality of heat exchangers, each heat exchanger heating a first fluid, the heating system also having a first refrigerant transfer selection means wherein the first plurality of heat exchangers comprises an air-to-refrigerant heat exchanger for transferring heat from the refrigerant to air and a water-to-refrigerant heat exchanger for transferring heat from the refrigerant to water, the first refrigerant transfer selection means being operable to select one of the air-to-refrigerant heat exchanger and the water-to-refrigerant heat exchanger to receive the refrigerant; and a cooling system having a second plurality of heat exchangers, each heat exchanger cooling a second fluid, the cooling system also having a second refrigerant transfer selection means, wherein the second plurality of heat exchangers comprises an air-to-refrigerant heat exchanger for transferring heat from air to the refrigerant and a water-to-refrigerant heat exchanger for transferring heat from water to the refrigerant, the second refrigerant transfer selection means being operable to select one of the air-to-refrigerant heat exchanger and the water-to-refrigerant heat exchanger to receive the refrigerant;

wherein the refrigerant is circulated by refrigerant circulation means to flow through the selected heat exchanger of the cooling system to absorb heat and to flow through the selected heat exchanger of the heating system to release heat.

2. The heating and cooling apparatus of claim 1, wherein the water-to-refrigerant heat exchanger of the heating system comprises a water-storage vessel containing water that is heated by the refrigerant when the first refrigerant transfer selection means selects the water-to-refrigerant heat exchanger of the heating system.

3. The heating and cooling apparatus of claim 1, wherein the water-to-refrigerant heat exchanger of the cooling system comprises a water-storage vessel containing water that is cooled by the refrigerant when the second refrigerant transfer selection means selects the water-to-refrigerant heat exchanger of the cooling system.

4. The apparatus of claim 1, further comprising an air handler for moving air cooled by the air-to-refrigerant heat exchanger of the cooling system to the air-to-refrigerant heat exchanger of the heating system, which then heats the cooled air when the first refrigerant transfer selection means selects the air-to-refrigerant heat exchanger of the heating system and the second refrigerant transfer selection means selects the air-to-refrigerant heat exchanger of the cooling system, whereby moisture is removed from the air that is moved by the air handler.

5. A method for concurrently heating and cooling materials, the method comprising:

providing a heating system comprising an air-to-refrigerant heat exchanger for transferring heat from a refrigerant to air and a water-to-refrigerant heat exchanger for transferring heat from the refrigerant to water;

providing a cooling system comprising an air-to-refrigerant heat exchanger for transferring heat from air to the refrigerant and a water-to-refrigerant heat exchanger for transferring heat from water to the refrigerant;

circulating the refrigerant through the heating system and the cooling system;

selecting one of the air-to-refrigerant heat exchanger and the water-to-refrigerant heat exchanger of the heating system to receive the circulating refrigerant; and selecting one of the air-to-refrigerant heat exchanger and the water-to-refrigerant heat exchanger of the cooling system to receive the circulating refrigerant;

whereby the selected heat exchanger of the heating system transfers heat from the refrigerant to a first fluid and the selected heat exchanger of the cooling system transfers heat from a second fluid to the refrigerant.

6. The method of claim 5, wherein the water-to-refrigerant heat exchanger of the heating system is selected and the first fluid is water that is heated by the circulating refrigerant.

7. The method of claim 5, wherein the the water-to-refrigerant heat exchanger of the cooling system is selected and the second fluid is water that is cooled by the circulating refrigerant.

8. The method of claim 5, wherein the water-to-refrigerant heat exchanger of the cooling system is selected and the method further comprises flowing water from a cold-water source through the water-to-refrigerant heat exchanger of the cooling system to cool the water.

9. The method of claim 8, wherein the cold-water source comprises a cold-water fish pond.

10. The method of claim 5, wherein the water-to-refrigerant heat exchanger of the heating system is selected and the method further comprises flowing water from a warm-water source through the water-to-refrigerant heat exchanger of the heating system to heat the water.

11. The method of claim 10, wherein the warm-water source comprises a warm-water fish pond.

12. An apparatus for concurrent heating and cooling, the apparatus comprising:

a refrigerant circulation means having refrigerant transfer paths for transferring circulating refrigerant;

at least a first and a second path selection devices in fluid communications with the refrigerant transfer paths, the path selection devices selecting refrigerant transfer paths for refrigerant flow;

a heating system in fluid communications with the refrigerant transfer paths, the heating system comprising a water-to-refrigerant heat exchanger and an air-to-refrigerant heat exchanger, the water-to-refrigerant heat exchanger adapted to heat water by transferring heat from the refrigerant to the water whenever the refrigerant flows through the water-to-refrigerant heat exchanger, the air-to-refrigerant heat exchanger adapted to heat air by transferring heat from the refrigerant to the air whenever the refrigerant flows through the air-to-refrigerant heat exchanger; and a cooling system in fluid communications with the refrigerant transfer paths, the cooling system comprising a water-to-refrigerant heat exchanger and an air-to-refrigerant heat exchanger, the water-to-refrigerant heat exchanger adapted to cool water by transferring heat from the water to the refrigerant whenever the refrigerant flows through the water-to-refrigerant heat exchanger, the air-to-refrigerant heat exchanger adapted to cool air by transferring heat from the air to the refrigerant whenever the refrigerant flows through the air-to-refrigerant heat exchanger;

wherein the first path selection device selects one of the water-to-refrigerant heat exchanger and the air-to-refrigerant heat exchanger of the heating system to be in fluid communications with the refrigerant circulation system and receive the refrigerant, the second path selection device selects one of the water-to-refrigerant heat exchanger and the air-to-refrigerant heat exchanger of the cooling system to be in fluid communications with the refrigerant circulation system and receive the refrigerant, wherein heat absorbed by the refrigerant in the cooling system is conveyed by the refrigerant circulation system to the heating system, where heat is released by the refrigerant.

13. The apparatus of claim 12, wherein the water-to-refrigerant heat exchanger of the cooling system comprises a cold-water-storage vessel that contains water that is cooled whenever the second path selection device selects the water-to-refrigerant heat exchanger of the cooling system to receive the refrigerant.

14. The heating and cooling apparatus of claim 13 wherein the water-to-refrigerant heat exchanger of the heating system comprises a hot-water-storage vessel that contains water that is heated whenever the first path selection device selects the water-to-refrigerant heat exchanger of the heating system to receive the refrigerant.

15. The heating and cooling apparatus of claim 14, wherein the refrigerant circulation means comprises a compressor that causes the refrigerant to flow through the refrigerant transfer paths.

16. The heating and cooling apparatus of claim 12, further including an air handling system operable to cause air to flow from the air-to-refrigerant heat exchanger of the cooling system to the air-to-refrigerant heat exchanger of the heating system so as to dehumidify the air.

17. The heating and cooling apparatus of claim 12, wherein the first and second path selection devices comprises a first and second valves.

18. The heating and cooling apparatus of claim 17, wherein the first valve is operable to cause refrigerant to flow to the water-to-refrigerant heat exchanger or to the air-to-refrigerant heat exchanger of the heating system, and the second valve is operable to cause refrigerant to flow to the water-to-refrigerant heat exchanger or to the air-to-refrigerant heat exchanger of the cooling system.

19. The heating and cooling apparatus of claim 12, further comprising a first pump and a second pump, the first pump operable to cause water to flow through the water-to-refrigerant heat exchanger of the heating system, the second pump operable to cause water to flow through the water-to-refrigerant heat exchanger of the cooling system.

20. The heating and cooling apparatus of claim 19, wherein the first pump circulates water from a warm-water fish pond through the water-to-refrigerant heat exchanger of the heating system and the second pump circulates water from a cold-water fish pond through the water-to-refrigerant heat exchanger of the cooling system.

21. The heating and cooling apparatus of claim 12, wherein refrigerant flow to the water-to-refrigerant heat exchanger of the cooling system is selected.

22. The heating and cooling apparatus of claim 21, wherein refrigerant flow to the water-to-refrigerant heat exchanger of the heating system is selected.

23. The heating and cooling apparatus of claim 22, further including a first water circulation means for transferring water into and transferring water out of the water-to-refrigerant heat exchanger of the heating system.

24. The heating and cooling apparatus of claim 23, further including a second water circulation means for transferring water into and transferring water out of the water-to-refrigerant heat exchanger of the cooling system.

25. The heating and cooling apparatus of claim 12, wherein:

the first path selection device comprises:

a first switching valve for selecting refrigerant transfer from the refrigerant circulation system to the water-to-refrigerant heat exchanger or the air-to-refrigerant heat exchanger of the heating system; and first and second check valves, for permitting refrigerant transfer only between the refrigerant circulation system and the heat exchanger of the heating system that is selected by the first switching valve; and the second path selection device comprises:

a second switching valve for selecting refrigerant transfer from the refrigerant circulation system to the water-to-refrigerant heat exchanger or the air-to-refrigerant heat exchanger of the cooling system; and third and fourth check valves, for permitting refrigerant transfer only between the refrigerant circulation system and the heat exchanger of the cooling system that is selected by the second switching valve.

* * * * *

UNITED STATES PATENT AND TRADEMARK OFFICE

CERTIFICATE OF CORRECTION

PATENT NO. : 6,751,972 B1
APPLICATION NO. : 10/299441
DATED : June 22, 2004
INVENTOR(S) : Jungwirth It is certified that error appears in the above-identified patent and that said Letters Patent is hereby corrected as shown below:

In the Claims:

Column 10, lines 7-8, “comprises a” should read -- comprise --

Signed and Sealed this

Eighth Day of August, 2006

JON W. DUDAS
*Director of the United States Patent and Trademark Office*